US007264524B2

(12) United States Patent
Batt

(10) Patent No.: US 7,264,524 B2
(45) Date of Patent: Sep. 4, 2007

(54) ADJUSTABLE FIN SYSTEM

(76) Inventor: Michael Batt, PO Box 384, Margaret River, WA 6285 (AU)

( * ) Notice: Subject to any disclaimer, the term of this patent is extended or adjusted under 35 U.S.C. 154(b) by 0 days.

(21) Appl. No.: 10/516,862

(22) PCT Filed: May 2, 2003

(86) PCT No.: PCT/AU03/00517

§ 371 (c)(1),
(2), (4) Date: Dec. 2, 2004

(87) PCT Pub. No.: WO03/095301

PCT Pub. Date: Nov. 20, 2003

(65) Prior Publication Data

US 2005/0260903 A1 Nov. 24, 2005

(30) Foreign Application Priority Data

May 7, 2002 (AU) ..... PS2163

(51) Int. Cl.
*B63B 1/00* (2006.01)

(52) U.S. Cl. ..... 441/79

(58) Field of Classification Search ..... 441/74, 441/79; 114/140

See application file for complete search history.

(56) References Cited

U.S. PATENT DOCUMENTS 3,585,663 A * 6/1971 Johnson ..... 441/79
4,044,416 A 8/1977 Brewer et al.
4,320,546 A * 3/1982 Knox ..... 441/74
4,421,492 A 12/1983 Leva
5,215,488 A 6/1993 Bailey
5,934,963 A 8/1999 Frizzell
5,997,376 A * 12/1999 Block et al. ..... 441/79
RE38,840 E * 10/2005 Patterson ..... 441/79

FOREIGN PATENT DOCUMENTS

| | | |
|---|---|---|
| AU | 60532/86 | 1/1987 |
| DE | 3044714 | 6/1982 |
| FR | 2510968 | 2/1983 |
| WO | 00/32466 | 6/2000 |

* cited by examiner

*Primary Examiner*—Ed Swinehart
(74) *Attorney, Agent, or Firm*—Klarquist Sparkman, LLP

(57) ABSTRACT

An adjustable fin system for a watercraft such as a surfboard, includes a fin having a base, a foot extending from the base, a fin box mountable within a hull of the watercraft and a manually operable detent mechanism for releasably holding the fin in a plurality of different positions relative to the fin box. The fin box defines a cavity for receiving the foot. The cavity has an opening on a first surface through which the foot is inserted. The opening and the base are relatively dimensioned so that when the foot is received within the cavity the base substantially covers the opening.

19 Claims, 5 Drawing Sheets

ADJUSTABLE FIN SYSTEM

CROSS REFERENCE TO RELATED APPLICATIONS

This is the U.S. National Stage of International Application No. PCT/AU03/00517, filed May 2, 2003, which was published in English under PCT Article 21(2), which in turn claims the benefit of Australian Provisional Application No. PS 2163, filed May 7, 2002. Both applications are incorporated herein in their entirety.

FIELD

The present invention relates to an adjustable fin system for a watercraft and in particular, though not exclusively, for a surfboard.

BACKGROUND

Many different types of adjustable fin systems are known particularly in relation to surfboards. One such system is described in U.S. Pat. No. 4,044,416 (Brewer et al) which discloses a fin holder set in the underside of a surfboard defining an elongate channel for receiving the base of a fin for lengthwise adjustment of the fin relative to the surfboard. A clamp is provided which is slidable lengthwise in the channel and is engagable with the fin for releasably retaining the fin relative to the surfboard.

A further system is described in U.S. Pat. No. 5,997,376 (Block et al) which discloses a fin mounting system for a surfboard including a box which is embedded within a surfboard by producing a through cavity within the surfboard, placing the box within the through cavity and then pouring a hardenable resin between the box and the cavity to fix the same in the surfboard. A separate fin is then inserted into the box. The fin is adjustable longitudinally and can be fixed into a number of different positions by way of a fastener comprising a conventional nut and bolt where the nut is embedded into the fin.

Another system is described in U.S. Pat. No. 5,215,488 (Bailey) which teaches the insertion of a mounting box defining an elongated channel into the hull of a watercraft and a fin adjustably mounted in the mounting box. A locking device is provided for adjustably locking the fin at different positions along the channel. The locking device includes a flat parallelogram shaped locking nut with a rotational biasing spring which are supported by the fin, with the nut receivable within an internal recessed lateral groove formed in the elongated channel.

Further fin mounting systems are described in U.S. Pat. No. 4,421,492 (Leva) and U.S. Pat. No. 5,934,963 (Frizzell).

While all of the abovementioned fin mounting systems provide different means for moving a fin longitudinally relative to the hull of a watercraft, they suffer from one or more of the following problems. The mounting boxes in many cases are provided with openings for receiving a fin which are exposed to water flow, or are provided with clamps or other locking devices which are directly exposed to water flow thus adversely affecting the hydrodynamics of the associated water craft. Some of the systems also require the use of screws or nuts which require tools such as screwdrivers or spanners in order to allow adjustment of the fin. These systems are particularly disadvantageous if it is required to change the position of the fin while in the water where typically, at least in the case of a surfboard, the user of the craft would not be in possession of such tools. Further, systems which require screws, nuts and/or springs are often subject to rapid degradation by action of water, and in particular salt water. Another problem is that the typical forces created in use of the fins act in a manner to disengage the fin in some of the prior at mounting systems.

SUMMARY

It is an object of the present invention to provide an adjustable fin system for a watercraft which attempts to overcome at least one of the abovementioned problems in the known prior art.

According to the present invention there is provided an adjustable fin system for a Watercraft having a hull, said system including at least:

a fin having a base;

a foot coupled to said base;

a fin box mountable in the hull of said water craft, said fin box defining a cavity for receiving said foot, said cavity having an opening on a first surface of said fin box through which said foot is inserted, said opening and said base relatively dimensioned so that when said foot is received in said cavity, said base substantially covers said opening; and, a manually operable detent mechanism for releasably holding said fin in a plurality of different positions relative to said fin box.

Preferably said detent mechanism includes a first engagement means on said foot; and a second engagement means in said fin box; said first and second engagement means mutually engagable in a plurality of different positions along a length of said cavity.

Preferably said detent mechanism includes:

a first pin resiliently supported on said foot; and, a channel formed in said fin box and extending at least in part, in a direction of the length of said fin box;

wherein said first and second engagement means are mutually engaged when said first pin is in said channel, and the position of the fin is changeable relative to the fin box by resilient deflection of said first pin relative to said foot and sliding of said first pin along said channel.

Preferably said foot is provided with a second transversely extending pin, wherein said second pin and said first engagement means are respectively located near opposite ends of said foot and said first pin is intermediate of said second pin and said first engagement means.

Preferably said channel includes first and second portions for receiving said first and second pins respectively, wherein said first and second portions are spaced from each other in a direction transverse to the length of said fin box.

Preferably said fin box includes a feed channel connecting said first and second portions and extending to said opening.

Preferably one of said first and second engagement means is in the form of an elongated rack and the other of said first and second engagement means is in the form of at least one tooth for engaging said rack.

Preferably said detent mechanism includes a resilient element which supports said first pin, said resilient element supported by said foot.

In one embodiment said resilient element is in the form of a body of resilient material disposed in a recess formed in said foot.

In an alternate embodiment said detent mechanism includes a finger coupled at one end to said foot.

Preferably said foot includes a first part attached to said base and a second part extending from one side of said first part in a plane containing said fin and spaced from said base.

BRIEF DESCRIPTION OF THE DRAWINGS

Embodiments of the present invention will now be described by way of example only with reference to the accompanying drawings in which.

DETAILED DESCRIPTION

Figure 2:
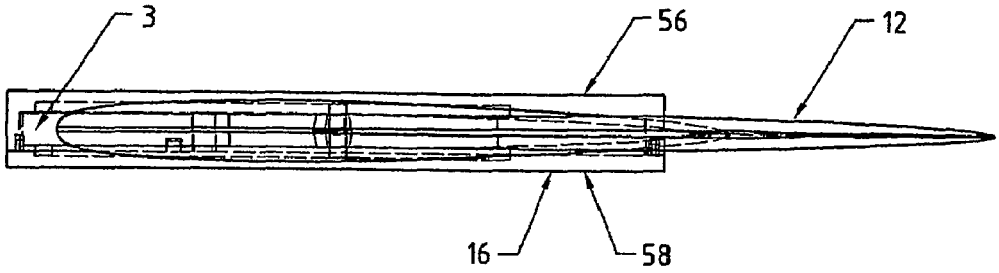
FIG. 2 is a top view of the adjustable fin system depicted in FIG. 1.
Figure 1:
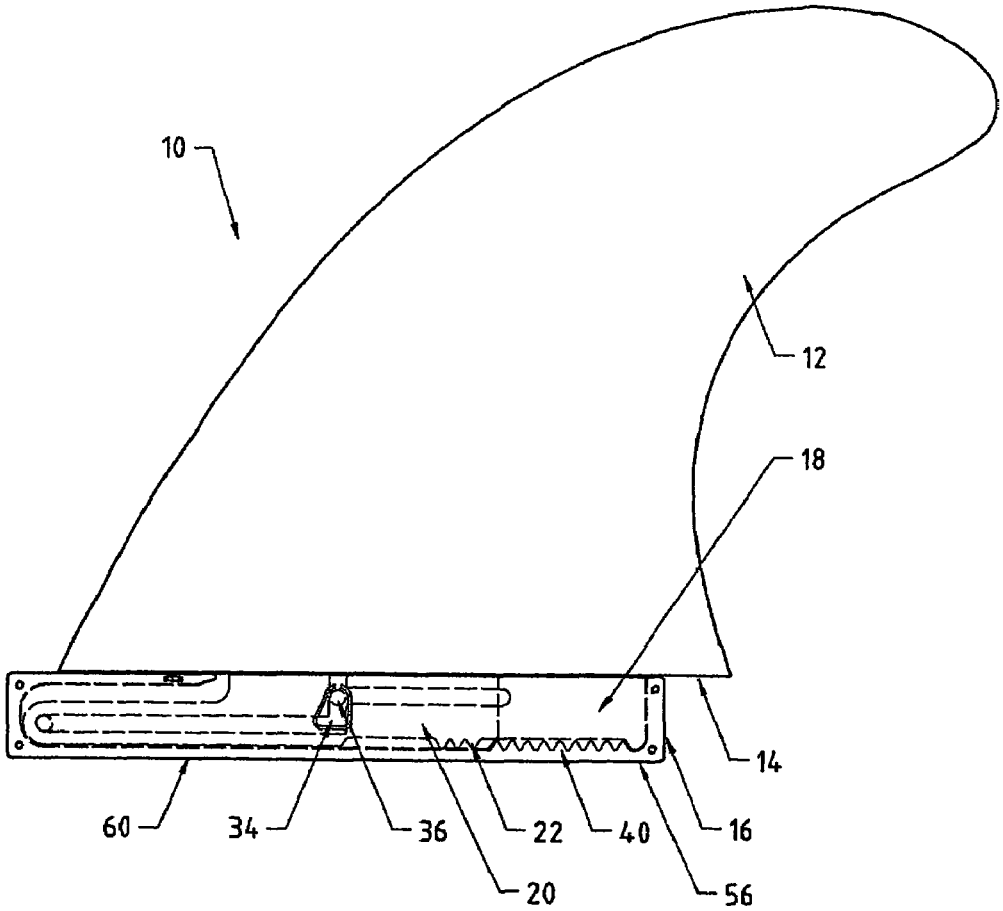
FIG. 1 is a side view of one embodiment of the adjustable fin system.

Referring to the accompanying drawings, and in particular FIGS. 1 and 2, it can be seen that an adjustable fin system 10 for a water craft such as a surfboard (not shown) includes a fin 12 having a base 14, a fin box 16 mountable within a hull of the surfboard, and a manually operable detent mechanism 18 for releasably holding the fin 12 in a plurality of different positions relative to the fin box 16. The fin 12 includes a foot 20 which extends from the base 14 and is provided with first engagement means in the form of teeth 22 on a lower surface 24 near one end 26 of the foot 20. The fin box 16 defines a cavity 28 for receiving the foot 20. The cavity 28 has an opening 30 (see FIG. 7) on a first surface 32 through which the foot 20 is inserted. The opening 30, and the base 14 of the fin 12 are relatively dimensioned so that when the foot 20 is received within the cavity 28 the base 14 substantially covers the opening 30.

The detent mechanism 18 includes a resilient element which in the present embodiment is in the form of a block or body 34, supported by the foot 20, a first pin 36 supported by the resilient element 34 (see in particular FIGS. 1, 3 and 5), the teeth 22 (ie first engagement means) formed on the foot 20; a channel 38 formed in the fin box 16 and extending at least in part in a direction of the length of the fin box; and, a second engagement means in the form of a rack of teeth 40 provided in the cavity 28.

The teeth 22 are engagable with the rack 40 in a plurality of different positions along a portion of the length of the cavity 28 when the pin 36 is in the channel 38. The position of the fin 12 relative to the fin box 16 can be varied or changed from one position to another by compression of the resilient element 34 and sliding of the pin 36 along the channel 38.

The various components and operation of the system 10 will now be looked at in greater detail.

Figure 3:
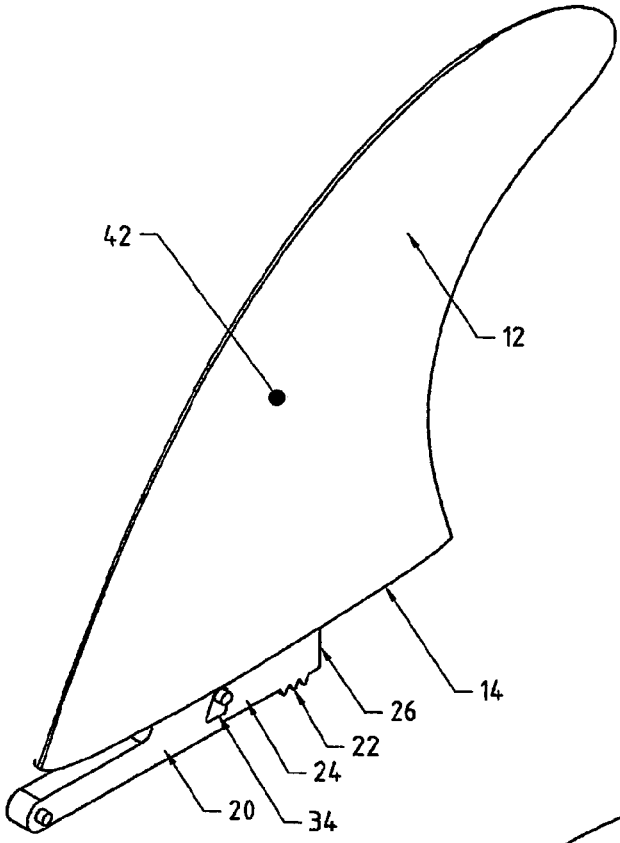
FIG. 3 is a perspective view of a fin incorporated in the adjustable fin system shown in FIGS. 1 and 2.
Figure 5:
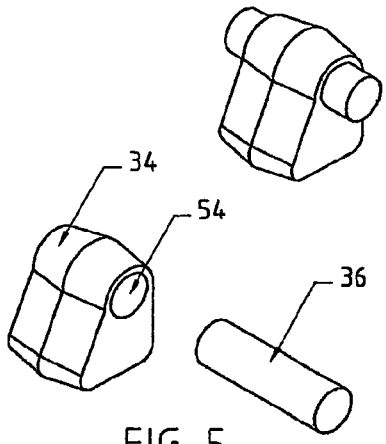
FIG. 5 is an exploded perspective view of the resilient element and pin incorporated in the fin depicted in FIG. 3.
Figure 4:
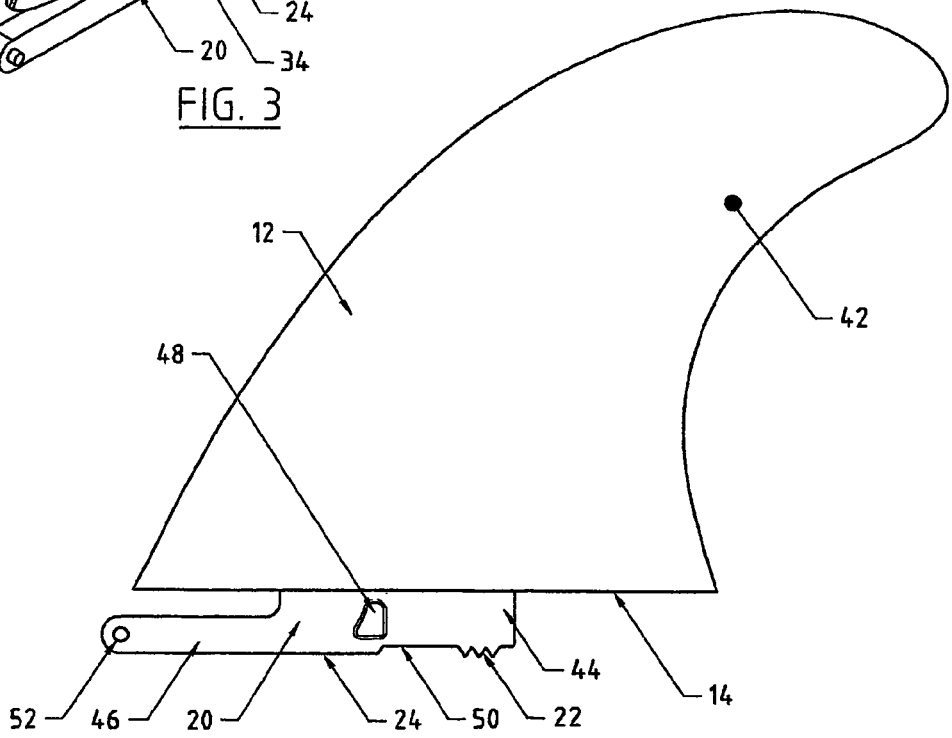
FIG. 4 is a side view of the fin depicted in FIG. 3 with a resilient element and pin of the system removed.

Referring in particular to FIGS. 3-5, the fin 12 is provided with a main body 42. The body 42 may be made of any desired known shape and configuration. Attached to the base 14 and extending in the plane of the body 42 is the foot 20. However, in the case of a symmetrical fin (not shown), the foot 20 may lie in a plane slightly angled (eg 4° to 6°) from the plane of the fin body 42. The foot 20 includes a first part 44 which depends from the base 14, and a second part 46 which extends from one side of first part 44 parallel to and spaced from the base 14. A hole 48 (see FIG. 4) is formed in the first part 44 for receiving the resilient element 34.

The lower surface 24 of the foot 20 is provided with a recessed portion 50 which contains the teeth 22. Depending on the relative position of the fin 12 and the fin box 16, the recess 50 accommodates a section of the rack 40. A second transversely extending pin 52 is provided in the foot 20 near the free end of the second part 46.

The resilient element 34 is in the form of a block of resilient material such as rubber and is provided with a transversely extending hole 54 through which the pin 36 passes. The element 34 is of a thickness similar to the thickness of the foot 20 with the pin 36 having opposite ends extending from the hole 54.

Figure 6:
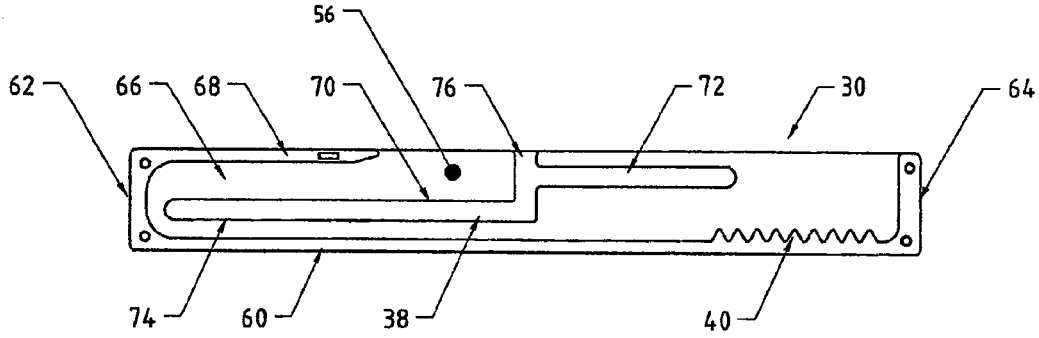
FIG. 6 is a plan view of one part of a mounting box incorporated in the adjustable fin system.
Figure 7:
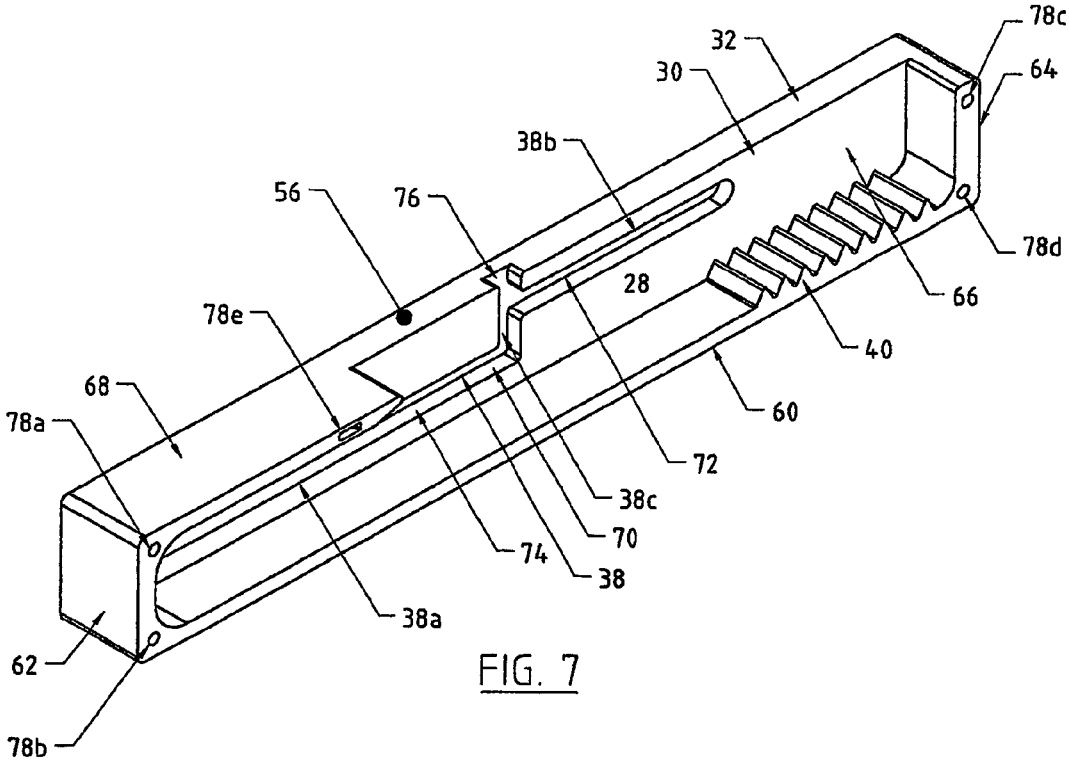
FIG. 7 is a perspective view of the part of the fin box depicted in FIG. 6.

As shown most clearly in FIG. 2, the fin box 16 is formed from two elongate shell sections 56 and 58 which are coupled together. The shell section 56 is depicted in FIGS. 6 and 7. The shell section 56 includes a bottom wall 60, upwardly extending end walls 62 and 64, a side wall 66 which extends between the bottom wall 60 and end wall 62,64; and, a top wall 68 extending laterally from an upper edge of the side wall 66. The top wall 68 in part forms the first surface 32.

A slot 70 is formed on the inside surface of the side wall 66 and forms one side of the channel 38. The slot 70 is provided with a first length 72 running parallel to the bottom wall 60 and extending from above about the second left most tooth on rack 40 to about half way along the length of the side wall 66. A second length 74 of the slot 70 runs parallel to bottom wall 60 and first length 72, and extends from a position approximately half way along the length of the side wall 66 terminating close to the end wall 62. A feed slot 76 extends upwardly connecting the first and second lengths 72,74 and opening onto the opening 30, top wall 68 and first surface 32. That is, the lengths 72 and 74 are spaced or offset from each other in a direction transverse to the length of the fin box 16.

A length of the top wall 68 extending from the end wall 62 to a position roughly in line with the mid-point of the second length 74 is formed with the same width as the end wall 62 and the bottom wall 60. However the remainder of the top wall 68 is reduced in width to the thickness of the side wall 66. When the shell sections 56 and 58 are coupled together, it is this reduction in the width of the top wall 68 which defines the opening 30.

Locating holes 78*a*-78*d* are formed at opposite ends of the end walls 62 and 64, with a further locating slot 78*e* formed in the side of the top wall 68.

Figure 8:
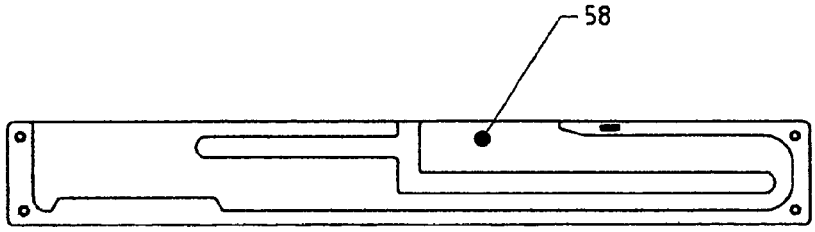
FIG. 8 is a plan view of a second part of the fin box incorporated in the adjustable fin system.
Figure 9:
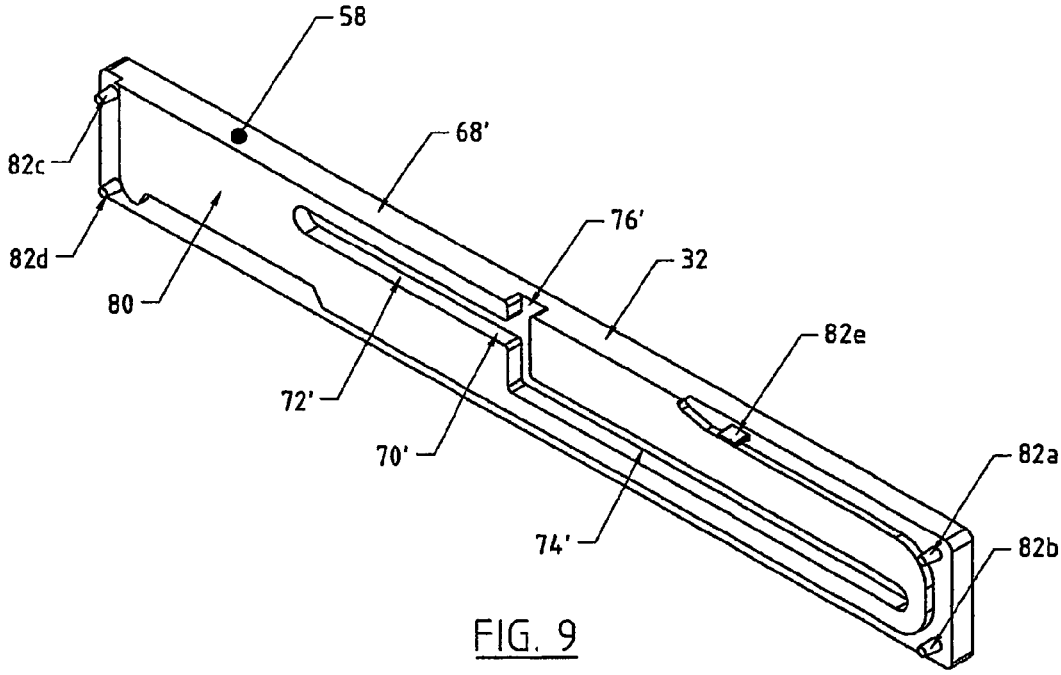
FIG. 9 is a perspective view of the second part of the fin box depicted in FIG. 8.

Referring to FIGS. 8 and 9, the shell portion 58 of the fin box 16 is in the form of a rectangular plate which, on an inside surface 80, is provided with a slot 70' configured as a mirror image of the slot 70 described above and depicted in FIGS. 6 and 7. The slot 70' includes a first length 72', second length 74' and feed slot 76'. The surface of top wall 68' of the plate constituting the shell section 58 forms part of the first surface 32 when the shell sections 56 and 58 are combined to form the fin box 16. Locating pins 82*a*-82*d* extend transversely of the surface 80 for registration with, and location in, locating holes 78*a*-78*d* respectively. A transversely extending tab 82*e* is also formed on the surface 80 for registration with and location in the locating slot 78*e*.

The cavity 28 is defined by coupling the shells 56,58 together forming the fin box 16. When this occurs, the slot lengths 72 and 72'; 74 and 74'; and feed slots 76 and 76' are facing each other to define the channel 38. The facing lengths 72 and 72' form a first portion 38*a* of the channel 38, the facing lengths 74 and 74' form a second portion 38*b* of the channel 38 and facing feed slots 76 and 76' form a feed channel 38*c*.

When in use, the fin box 16 is constructed by fixing the shell sections 56 and 58 together, for example with glue or heat welding, and then disposing the fin box into a recess formed in the hull of a water craft such as a surfboard. The fin box 16 is inserted into the recess with bottom wall 60 first, and disposed so that the surface 32 is coplanar with the hull of the surfboard. The fin box may then be glued in place by use of epoxy resins or other materials. To insert the fin, the pin 52 is inserted into the feed channel 38*c* constituted by the feed slots 76 and 76' to the bottom of that channel until it reaches the second channel portion 38*b*. The pin 52 is then slid along the channel portion 38*b* toward end wall 62. As this occurs, the fin pivots downwardly about pin 52 until the pin 36 is aligned with the feed channel 38*c*. Pin 36 is then inserted into the feed channel 38*c* to a position where it is in alignment with the first channel portion 38*a*. This arrangement is depicted in FIG. 1. In this configuration, the teeth 22 are spaced from and not in engagement with the rack 40. With reference to FIG. 1, by sliding the fin 12 a short distance to the right the teeth 22 initially abut the rack 40. In order to effect engagement of the teeth 22 with the fin 40 the fin is now pivoted in an anti-clockwise direction about pin 52. This causes compression of the resilient element 34 lifting the teeth 22 from the bottom wall 60. By now continuing to pull the fin 12 toward the right, the teeth 22 can be disposed above selected teeth of the rack 40. When the desired location of the fin 12 has been reached, the compression on the resilient element 34 can be released which in turn biases the fin 12 to pivot in the clockwise direction about pin 52 bringing the teeth 22 into engagement with the rack 40.

It would be appreciated that the position of the fin 12 relative to the fin box 16 can be manually varied for the length of the rack 40 by compressing the resilient element 32 by rotating the fin anti-clockwise about the pin 52 and then sliding the fin left or right to a desired location and subsequently releasing the pressure on the resilient element 34. No tools are required to effect the change in position. Further, when the fin 12 is in either of its extremes positions, that is with the right most tooth 22 engaging the left most tooth on rack 40; and the right most tooth 22 engaged between the last two teeth on the right hand side of the rack 40, the base of the fin 14 covers the opening 30 thereby substantially eliminating any drag, turbulence or adverse hydrodynamic effects otherwise caused by water flowing into the opening 30. It should also be appreciated that the forces that normally act on the fin when in use tend to increase the force of engagement between the teeth 22 and the rack 40.

Figure 11:
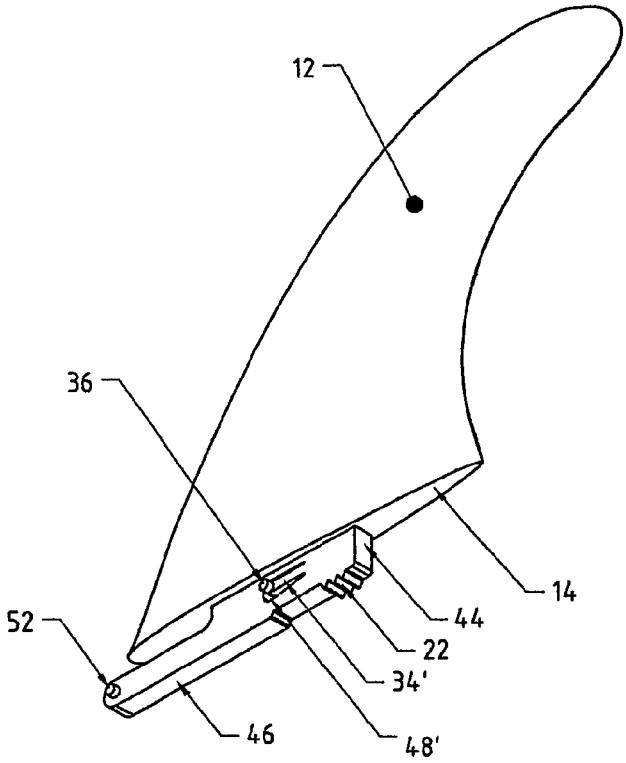
FIG. 11 is a perspective view of the fin depicted in FIG. 10.
Figure 12:
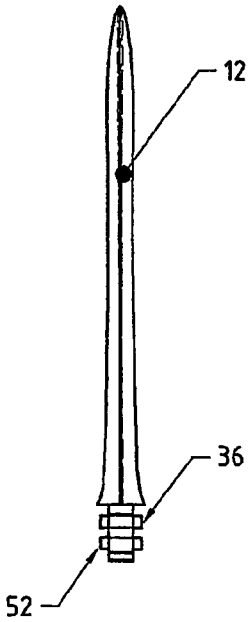
FIG. 12 is an end view of the fin depicted in FIG. 10.
Figure 10:
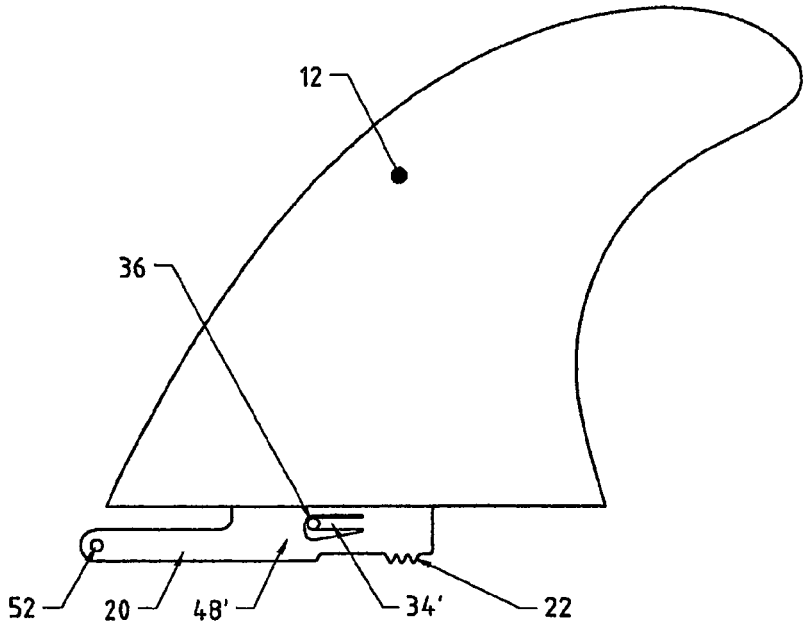
FIG. 10 is a side view of a fin for a second embodiment of the adjustable fin system.

FIGS. 10-12 depict a fin 12' for incorporation in a second embodiment of the adjustable fin system. In this embodiment, features which are identical to those of the first embodiment are denoted by the same reference numbers while features which are similar in function but different in structure are denoted with the same reference numbers but with the addition of a ' symbol.

In essence, the fin 12 depicted in FIGS. 10-12 differs from that of the first embodiment by forming the resilient element 34' as a finger or spring which is coupled at one end to the foot 20 and extends into a hole 48' formed in the foot 20 The pin 36 extends laterally from opposite sides at the other end of the finger 34'. Ideally, the finger 34' and pin 36 would be formed integrally with the remainder of the fin 12.

In this embodiment, the resilient biasing of the pin 36 is now provided by the resilience of the finger 34'. This resilience may be a function solely of the material from which the finger 34'/foot 20 is made or alternately in the event that the finger 34' is formed separately of the foot 20, by virtue of a resilient coupling or fixing of the finger 34' to the foot 20. The fin depicted in this embodiment functions in exactly the same way as that depicted in FIGS. 1-9.

Now that an embodiment of the present invention has been described in detail it will be apparent to those skilled in the relevant arts that numerous modifications and variations may be made without departing from the basic inventive concepts. For example, the detent 18 is described and depicted as including a rack 40 formed in the cavity 28 and teeth 22 formed on the foot 20. However these may be reversed with the rack being provided on the foot and the teeth 22 formed in the cavity. In addition, the rack and teeth can be replaced by other inter-engagable elements, such as pins and holes for receiving the pins. Also, the resilient element 34 is depicted as including a hole 54 for receiving the pin 36. However in a further variation, the element 34 may instead simply be profiled so as to form with the hole 48 a passage for receiving the pin 36. In another variation, the fin box may be manufactured in different ways than depicted, for example as upper and lower half shells, rather than side shells, or indeed as an assembly of more than two components.

All such modifications and variations together with others that would be obvious to a person of ordinary skill in the art are deemed to be within the scope of the present invention the nature of which is to be determined from the above description.

The invention claimed is:

1. An adjustable fin system for a watercraft having a hull, said system including at least:

a fin having a base;

a foot coupled to said base, said foot having a first portion extending from said base and a second portion extending from said first portion, the second portion being spaced apart from said base such that a fin box receiving area is defined between the second portion of the foot and the base;

a fin box mountable in the hull of said watercraft, said fin box having a top wall, a bottom wall generally opposite the top wall, and side walls intermediate the top and bottom walls, the walls defining a cavity for receiving said foot, said cavity having an opening on a first surface of the top wall of said fin box through which said foot is inserted; and a manually operable detent mechanism for releasably holding said fin in a plurality of different positions relative to said fin box;

wherein said opening and said base are relatively dimensioned so that when said foot is received in said cavity and when said fin is in any of the plurality of different positions, said base substantially covers said opening and at least a portion of the top wall is positioned between the base and second portion of the foot within the fin box receiving area.

2. The system according to claim 1 wherein said detent mechanism includes a first engagement means on said foot; and a second engagement means in said fin box; said fast and second engagement means mutually being engagable in a plurality of different positions along a length of said cavity.

3. The system according to claim 2 wherein said detent mechanism includes a first pin resiliently supported on said foot and a channel formed in said fin box and extending at least in part, in a direction of the length of said fin box, and wherein said first and second engagement means arc mutually engaged when said first pin is in said channel, and the position of the fin is changeable relative to the fin box by resilient deflection of said first pin relative to said foot and sliding of said first pin along said channel.

4. The system according to claim 3 wherein said detent mechanism includes a resilient element which supports said first pin, said resilient element supported by said foot.

5. The system according to claim 4 wherein said resilient element is in the form of a body of resilient material disposed in a recess formed in said foot.

6. The system according to claim 4 wherein said detent mechanism includes a finger coupled at one end to said foot.

7. The system according to claim 3 wherein said foot is provided with a second transversely extending pin, and wherein said second pin and said first engagement means are respectively located near opposite ends of said foot and said first pin is intermediate of said second pin and said first engagement means.

8. The system according to claim 7 wherein said channel includes first and second portions for receiving said first and second pins respectively, and wherein said first and second portions are spaced from each other in a direction transverse to the length of said fin box.

9. The system according to claim 8 wherein said fin box includes a feed channel connecting said first and second portions and extending to said opening.

10. The system according to claim 2 wherein one of said first and second engagement means is in the form of an elongated rack and the other of said first and second engagement means is in the form of at least one tooth for engaging said rack.

11. The system according to claim 3 wherein one of said first and second engagement means is in the form of an elongated rack and the other of said first and second engagement means is in the form of at least one tooth for engaging said rack.

12. The system according to claim 4 wherein one of said first and second engagement means is in the form of an elongated rack and the other of said first and second engagement means is in the form of at least one tooth for engaging said rack.

13. The system according to claim 5 wherein one of said first and second engagement means is in the form of an elongated rack and the other of said first and second engagement means is in the form of at least one tooth for engaging said rack.

14. The system according to claim 6 wherein one of said first and second engagement means is in the form of an elongated rack and the other of said first and second engagement means is in the form of at least one tooth for engaging said rack.

15. The system according to claim 7 wherein one of said first and second engagement means is in the form of an elongated rack and the other of said first and second engagement means is in the form of at least one tooth for engaging said rack.

16. The system according to claim 8 wherein one of said first and second engagement means is in the form of an elongated rack and the other of said first and second engagement means is in the form of at least one tooth for engaging said rack.

17. The system according to claim 9 wherein one of said first and second engagement means is in the form of an elongated rack and the other of said first and second engagement means is in the form of at least one tooth for engaging said rack.

18. An adjustable fin system for watercraft having a hull, comprising:

a fin terminating at one end in a foot;

a fin box mountable in the hull of said watercraft, the fin box comprising a cavity having an opening and sized to receive the foot of the fin, the cavity being larger than the foot in at least one dimension to allow movement of the foot within the cavity; and a fin lock capable of being released by hand and operable to releasably lock the fin in a desired one of a plurality of positions relative to tide cavity;

wherein the fin comprises an overlapping portion extending about an entire periphery of the fin adjacent the foot, the overlapping potion being sized to extend beyond an entire periphery of the opening when the foot is inserted in the cavity and the fin is in any one of the plurality of positions, the overlapping portion thereby restricting entry of water through the opening.

19. The adjustable fin system of claim 18 wherein the fin lock is a detent mechanism having respective portions on walls defining the cavity and the foot.

* * * * *

UNITED STATES PATENT AND TRADEMARK OFFICE

CERTIFICATE OF CORRECTION

PATENT NO. : 7,264,524 B2
APPLICATION NO. : 10/516862
DATED : September 4, 2007
INVENTOR(S) : Michael Batt It is certified that error appears in the above-identified patent and that said Letters Patent is hereby corrected as shown below:

In the Claims:

Column 7, line 13, “means arc” should read --means are--.

Column 8, line 42, “potion being” should read --portion being--.

Signed and Sealed this

Twenty-ninth Day of July, 2008

JON W. DUDAS
*Director of the United States Patent and Trademark Office*